US007284555B1

(12) United States Patent
Knox

(10) Patent No.: US 7,284,555 B1
(45) Date of Patent: Oct. 23, 2007

(54) MANICURING IMPLEMENT AND INSTRUMENTS INCLUDING SAME

(76) Inventor: Jeffrey S. Knox, 105 Maple Ave., Sea Cliff, NY (US) 11579

( * ) Notice: Subject to any disclaimer, the term of this patent is extended or adjusted under 35 U.S.C. 154(b) by 115 days.

(21) Appl. No.: 11/070,493

(22) Filed: Mar. 2, 2005

(51) Int. Cl.
*A45D 29/04* (2006.01)

(52) U.S. Cl. ..... 132/73.5; 132/75.6

(58) Field of Classification Search ..... 132/73, 132/73.5, 75, 75.3, 75.4, 75.5, 75.6, 76.2, 132/76.4, 76.5; 30/26, 28; 254/25; 451/461; 7/120, 162
See application file for complete search history.

(56) References Cited

U.S. PATENT DOCUMENTS

| | | | | | |
|---|---|---|---|---|---|
| 512,277 | A | * | 1/1894 | Clayton | 7/162 |
| 695,342 | A | * | 3/1902 | Reed | 30/29 |
| 875,681 | A | | 1/1908 | Asbury | |
| 881,125 | A | * | 3/1908 | Holmquist | 30/142 |
| 1,155,380 | A | * | 10/1915 | Swank | 132/75.6 |
| 1,234,845 | A | * | 7/1917 | Williamson | 132/75.6 |
| 1,285,863 | A | * | 11/1918 | Wild | 132/75.4 |
| D53,260 | S | * | 4/1919 | Tobel | D8/17 |
| 1,370,461 | A | | 3/1921 | Lobl | |
| 1,517,809 | A | * | 12/1924 | Tipton | 132/75 |
| 1,773,770 | A | * | 8/1930 | Adam | 132/75 |
| 1,828,121 | A | | 10/1931 | Adam et al. | |
| 1,905,976 | A | * | 4/1933 | Wolf | 132/75.3 |
| 2,279,533 | A | * | 4/1942 | Shore | 132/75.6 |
| 2,490,647 | A | * | 12/1949 | Norman | 132/76.4 |
| 2,516,423 | A | | 7/1950 | Roe | |
| 2,999,505 | A | | 9/1961 | Herstedt | |
| 3,203,433 | A | * | 8/1965 | Miller | 132/75.6 |
| 3,261,094 | A | | 7/1966 | Bliss | |
| 3,315,354 | A | | 4/1967 | Oates, Jr. | |
| 3,316,634 | A | | 5/1967 | Bliss | |
| 4,550,496 | A | * | 11/1985 | Reinicke | 30/124 |
| 5,088,509 | A | | 2/1992 | Savage, III | |
| 5,090,427 | A | | 2/1992 | Sherts | |
| 5,666,728 | A | | 9/1997 | Silva | |
| D391,024 | S | | 2/1998 | Bianco | |
| 5,782,247 | A | * | 7/1998 | Sadley et al. | 132/76.4 |
| D418,632 | S | * | 1/2000 | Fauerbach et al. | D28/59 |
| 6,038,754 | A | * | 3/2000 | Stafford | 29/267 |
| 6,155,270 | A | | 12/2000 | Samiean | |
| 6,289,901 | B1 | | 9/2001 | Singer et al. | |
| 6,553,592 | B2 | | 4/2003 | Yang et al. | |
| 6,758,220 | B2 | | 7/2004 | Willis | |
| 7,048,255 | B2 | * | 5/2006 | Buch et al. | 254/28 |

* cited by examiner

*Primary Examiner*—Todd E. Manahan
(74) *Attorney, Agent, or Firm*—Robert P. Michal; Frishauf, Holtz, Goodman & Chick, P.C.

(57) ABSTRACT

A manicuring implement includes a shaft and an operative head arranged at an end of the shaft and having first and second fixed jaws defining an indentation therebetween. The first jaw has a straight inner surface forming one side of the indentation and an outer surface having a straight portion on an opposite side. The second jaw has a curved inner surface forming the other side of the indentation and an outer surface having a curved portion on an opposite side. By forming the straight and curved portions on the outer surfaces of the jaws, a manicurist can readily determine the orientation of the implement and use the implement to cause either the straight or curved jaw to be inserted between the nail and the underlying skin to clean the underside of the nail. The indentation serves to limit the penetration of the jaws below the nail into the underlying skin and nail bed.

20 Claims, 4 Drawing Sheets

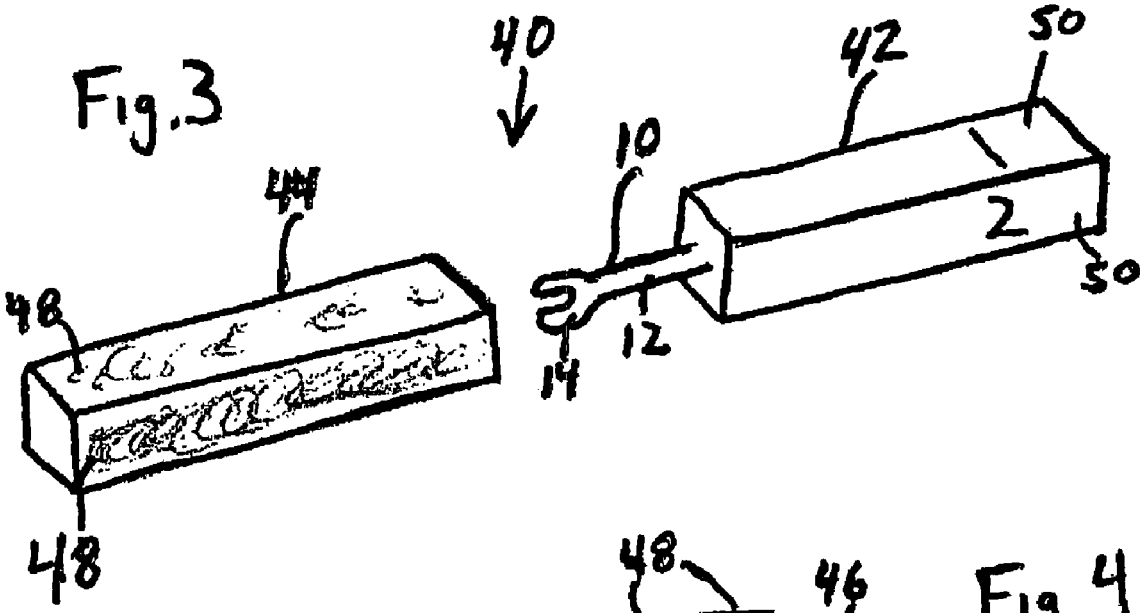
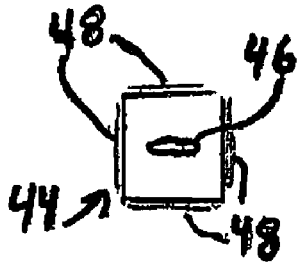
Fig.4

MANICURING IMPLEMENT AND INSTRUMENTS INCLUDING SAME

FIELD OF THE INVENTION

The present invention relates to a manicure implement for cleaning underneath a person's nails, and to manicure instruments including such an implement.

The present invention also relates to a manicure instrument which enables both cleaning underneath a person's nails as well as finishing the nails.

BACKGROUND OF THE INVENTION

When manicuring nails, various implements are used each having a different purpose, e.g., nail and cuticle trimming, brushing, and finishing processes such as coarse buffing, polishing and smooth buffing. In addition, a pick is often used to clean accumulated particulate matter from the area between the nail and the skin of the underlying part of the finger. The pick is inserted between the underside of the nail and the adjacent skin and scraped along the underside of the nail to thereby force the expulsion of any accumulated matter from below the nail. Such picks typically have an elongate body terminating at a pointed head region.

One problem with using such a pick to clean underneath nails is that there is no limitation on the depth to which the pick can be inserted into the area between the nail and the skin. As such, it is quite common for the pick to be over-inserted and puncture the nail bed causing bleeding, discomfort and the possibility of infection. The problem is prevalent with inexperienced manicurists and persons who manicure their own nails. It would therefore be desirable to provide a manicure implement as a replacement for a pick which inherently limits the depth to which the implement can penetrate into the area below the nail to thereby avoid puncturing the nail bed.

Another concern for manicurists and self-manicurists is that several implements are used during the course of a manicure. Each implement must be independently handled during the manicure and put down after use. As more implements are used, the handling thereof increases and thus fingernail maintenance can become a time-consuming activity. Moreover, implements can be misplaced.

To reduce the number of implements required to provide a complete manicure and thus time-consuming handling thereof, attempts have been made to provide a single instrument which has two or more different manicuring implements formed in connection therewith or arranged thereon. For example, U.S. Pat. No. 5,088,509 (Savage, III) describes a manicure file kit with several different manicuring implements all of which are used in conjunction with an S-shaped file body. An implement for trimming cuticles has the form of a V-shaped gap defined between a pair of spaced blades at one end of a planar section of the file body. A cuticle is received in the V-shaped gap and the file body is manipulated to cause trimming of the cuticle in the gap. A file surface is provided at another planar section of the file body to enable rough filing of the nails. A cover sheath is slidable over a planar section of the file body and has a file surface with a lesser coarseness than that formed on the file body and enables smooth buffing of the nails. A brush is also slidable over a planar section of the file body and enables brushing over the nails. Using the file body, a user can accomplish several different processes in the manicure, and possibly the entire manicure, without having to put the file body down. A reduction in the time to perform nail maintenance using the file body is therefore obtained.

Other manicure instruments having multiple manicuring implements, such as nail clippers and a filing surface, are described in U.S. Pat. No. 1,828,121 (Adam et al.), U.S. Pat. No. 2,999,505 (Herstedt), U.S. Pat. No. 3,261,094 (Bliss), U.S. Pat. No. 3,315,354 (Oates, Jr.), U.S. Pat. No. 3,316,634 (Bliss), U.S. Pat. No. 5,666,728 (Silva) and U.S. Pat. No. 6,553,592 (Yang et al.). These instruments lack an implement which is designed to clean underneath nails while limiting the penetration thereof below the nails to avoid puncturing the nail bed and causing bleeding.

OBJECTS AND SUMMARY OF THE INVENTION

It is an object of the present invention to provide a new and improved manicuring implement, which may be used, for example, to clean underneath nails.

It is another object of the present invention to provide a new and improved manicure instrument which has multiple implements attached thereto, one of which is a manicuring implement for cleaning underneath nails.

It is another object of the present invention to provide a new and improved manicure instrument which has manicuring implements enabling cleaning underneath nails as well as finishing the nails.

It is yet another object of the present invention to provide a new and improved manicure instrument which provides an indication of an optimal order in which different filing surfaces are to be used.

In order to achieve these objects and others, a manicuring implement in accordance with the invention includes a shaft and an operative head arranged at an end of the shaft and having first and second fixed jaws defining an indentation therebetween. The first jaw has a straight inner surface forming one side of the indentation and an outer surface having a straight portion on an opposite side. The second jaw has a curved inner surface forming the other side of the indentation and an outer surface having a curved portion on an opposite side. The formation of the straight and curved portions on the outer surfaces of the jaws enables a manicurist to readily determine the orientation of the implement and then use the implement to insert either the straight jaw or the curved jaw between the nail and the underlying skin to clean the underside of the nail. The presence of the indentation between the jaws serves to limit the penetration of the jaw being used for cleaning below the nail, into the underlying nail bed.

The implement can be used as a stand-alone manicuring instrument or in a manicuring instrument with other manicuring implements. In one embodiment, a handle is provided to which the shaft of the implement is mounted. The manicurist grips the handle for use of the implement.

For this instrument, a cover may be provided having files incorporated thereon. The cover includes a slot arranged to receive an exposed portion of the shaft and the head when the cover is arranged in connection with the handle. The cover can be designed to enable buffing, polishing, sanding and/or smoothing of the nails by providing different grade filing surfaces on sides thereof. An optimal order in which the filing surfaces are to be used can be provided by coloring the filing surfaces and aligning colored sides of the handle with the corresponding colored filing surfaces. The sides of the handle are numbered in the desired order for using the filing surfaces so that when the handle and cover are properly connected together with the same colors on the sides of the cover aligning with those on the handle, the order of use of the filing surfaces is provided by the numbers on the sides of the handle.

Another manicuring instrument including the manicuring implement described above includes upper and lower plates joined together at rear ends and defining opposing sharpened jaws at front ends. The manicuring implement is rotatably connected to the upper plate to swing outward from a storage position along the upper plate to an exposed, operative position. A lever is arranged to urge the jaw of the upper plate against the jaw of the lower plate to enable trimming of nails or cuticles. The lever rests in a storage position against the manicuring implement and to this end, the manicuring implement preferably includes upraised projections extending from edges, the lever being retainable in a storage position between the projections. Cushioning pads can be provided along the force-application surfaces of the lever and lower plate to improve the comfort of handling and using the manicuring instrument by, for example, reducing the abrasiveness of the hard metal surfaces of the lever and lower plate and reducing slipping of the manicurist's or self-manicurist's fingers along the lever and lower plate.

Another manicuring instrument including the manicuring implement described above includes upper and lower cheeks, and rivets or pivot pins for joining the upper and lower cheeks together at opposed ends. The manicuring implement is rotatably mounted to one of the rivets or pivot pins such that it is rotatable between a folded, storage position inside a gap between the upper and lower cheeks and an exposed, operational position extending outward from the upper and lower cheeks. Additional manicuring implements can be rotatably mounted to the rivets or pivot pins and rotatable between storage positions in the gap between the upper and lower cheeks and operational positions outside of the gap.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 3 is an exploded view of a manicuring instrument in accordance with the invention including the manicuring implement shown in FIG. 1;

FIG. 4 is an end view of the sanding cover of the manicuring instrument shown in FIG. 3;

DETAILED DESCRIPTION OF THE INVENTION

Figure 1:
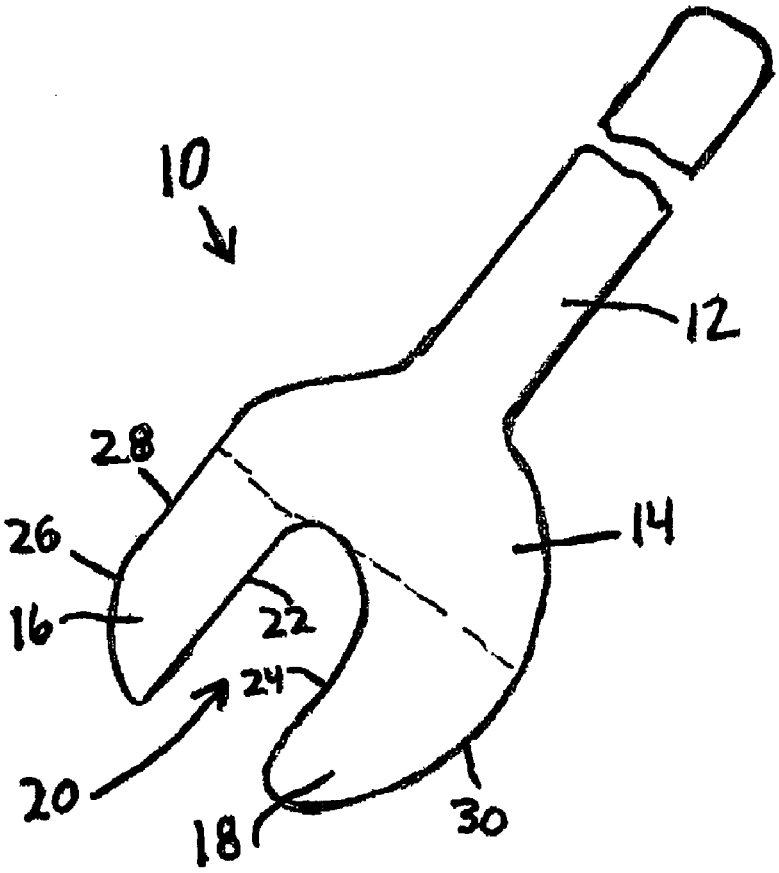
FIG. 1 is a perspective view of a manicuring implement in accordance with the invention.

Referring to the accompanying drawings wherein like reference numbers refer to the same or similar objects, FIG. 1 shows a manicuring implement 10 in accordance with the invention. Manicuring implement 10 includes an elongate shaft 12 and a substantially flat operative head 14 at one end of the shaft 12. The other end of the shaft 12 may be mounted or attached to a handle or manicure instrument (described below). Shaft 12 may taper to the end having the head 14 such that a middle portion of the shaft 12 is thicker than the head 14. Manicuring implement 10 may be formed of a rigid, metal or plastic material.

Head 14 has a particular construction effective to optimize the removal of particulate matter from underneath nails. Specifically, head 14 includes a pair of fixed jaws 16, 18 defining an indentation 20 therebetween. Jaw 16 is a straight-surface jaw in that its inner surface 22 forming one side of the indentation 20 is straight from a forward edge region of the jaw 16 to a back region of the indentation 20. Jaw 18 is a curved-surface jaw in that its inner surface 24 forming the other side of the indentation 20 is curved from a forward edge region of the jaw 18 to the back region of the indentation 20. Inner surface 24 is inwardly curved in the sense that a depression is formed between the forward edge and back regions of the jaw 18.

To provide an indication as to which of the side of the indentation 20 is straight or curved, the outer surface 26 of the jaw 16 includes a straight portion 28 while the outer surface 30 of the jaw 18, or a significant portion thereof, is curved. This is important since the size of the implement 10 may be quite small so that it would be difficult to view the head 14 and determine which jaw is straight and which is curved. By forming a straight portion 28 on the outer surface 26 on the jaw 16 with the straight inner surface 22 and forming a curved outer surface 30 on the jaw 18 with a curved inner surface 24, the manicurist can feel the outside of the jaws 16, 18 and determine which jaw is which and then use the desired jaw. Situations in which straight jaw 16 would be preferably used and when curved jaw 18 would be preferably used are described below.

Figure 2:
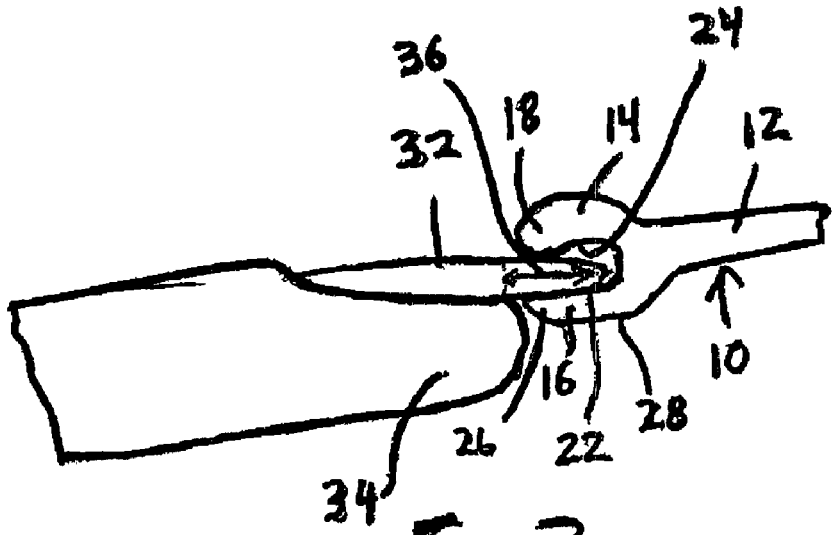
FIG. 2 is a side view showing one possible use of the manicuring implement shown in FIG. 1.

For use of manicuring implement 10, reference is now made to FIG. 2 wherein the straight jaw 16 is inserted underneath a nail 32 to a position between the underside of the nail and the skin of the finger 34 and moving the jaw 16 with straight surface 22 against the underside of the nail 32. Jaw 16 thereby effects the removal of particulate matter from underneath the nail 32. To improve the removal of particulate matter from underneath the nail 32, the manicuring implement 10 may be lightly push up against the underside of the nail 32 and rolled from side-to-side, alternatingly right-to-left and left-to-right.

Alternatively, it is possible to use manicuring implement 10 by inserting the curved jaw 18 underneath each nail 32 and moving the jaw 18 along the underside of the nail 32. The curved inner surface 24 aids in moving the skin below the nail 32 downward to avoid penetrating the nail bed.

The depth of penetration of the jaw 16 or jaw 18 below the nail 32 is limited by the depth of the indentation 20. A larger indentation 20 will enable deeper penetration of the jaws 16, 18 below the nail 32. The depth of the indentation 20 can be optimized in consideration of the typical extension 36 of the nail 32 beyond the underlying skin to enable the manicuring implement 10 to be optimally used by most people.

The use of the straight jaw 16 or the curved jaw 18 depends on various factors. For example, the straight jaw 16 will generally provide a greater depth of penetration than the curved jaw 18, assuming the thickness of the straight jaw 16 is less than the thickness of the curved jaw 18 as shown in FIG. 1. Another factor is relevant when individuals manicure themselves. In this case, the straight jaw 16 is easier to use when the manicuring implement 10 is gripped by the person's strong hand, i.e., a right-handed person would use the straight jaw 16 when holding the manicuring implement 10 in his/her right hand and cleaning the nails on his/her left hand, while the curved jaw 18 would be easier to use when the manicuring implement 10 is gripped by the person's weak hand, i.e., a right-handed person would use the curved jaw 18 when holding the manicuring implement 10 in his/her left hand and cleaning the nails on his/her right hand.

An additional use of the manicuring implement 10 is to remove dead cuticle skin. This may be achieved by lightly pushing the straight portion 28 or the curved portion 30 against the cuticle so that dead cuticle skin is torn as the straight portion 28 or curved portion 30 is moved along and over the underlying nail. Alternatively, the manicuring implement 10 can be positioned so that the cuticle is in the indentation 20 and the front edge of the inner surface 22 of the straight jaw 16 or the inner surface 24 of the curved jaw 18 is pushed against the cuticle so that dead cuticle skin is torn as the jaw 16 or 18 is moved along and over the underlying nail.

Referring now to FIGS. 3 and 4, a manicuring instrument which includes the manicuring implement 10 is designated generally as 40 and includes a handle 42 to which the end of the shaft 12 opposite the head 14 is fixed. Handle 42 may be made of plastic, rubber or other materials.

Manicuring instrument 40 also includes a cover 44 having the same cross-sectional shape as the handle 42. Cover 44 includes an elongate slot 46 (see FIG. 4) which receives an exposed portion of the shaft 12 and operative head 14 of the implement 10 when the cover 44 is fully engaged with the handle 42. The cross-sectional shape of the slot 46 may be dimensioned to substantially conform to, or be only slightly larger than, the outer dimensions of the inserted portion of the shaft 12 and head 14 to provide for a frictional engagement between the shaft 12 and head 14 and the interior walls of slot 46. This frictional engagement serves to prevent the cover 44 from inadvertently sliding out of engagement with the handle 42. Alternatively, an attachment mechanism can be provided on the handle 42 and/or cover 44 to removably connect the handle 42 and cover 44 together, e.g., strips of Velcro® or an adhesive such as double-sided tape.

Each axially extending side 48 of the cover 44 has a different filing surface. For example, sides 48 can include a very coarse sanding surface, a buffing surface, a polishing surface and a smoothing surface. To readily facilitate identification of the different filing surfaces on the sides 48 of the cover 44 and the order in which the filing surfaces may be optimally used, the sides 50 of the handle 42 (or pads arranged on the sides 50 of the handle 42) are numbered 1-4 and colored the same colors as the colors of the filing surfaces on the sides 48 of the cover 44. Thus, when the cover 44 is mated with the handle 42, the colors on the sides 50 of the handle 42 are aligned with the colors of the filing surfaces on the sides 48 of the cover 44.

Use of the filing surfaces on the sides 48 of the cover 44 can then proceed in the proper manner, when the cover 44 is engaged with the handle 42, by using the filing surface aligning with the number 1 on the side of the handle 42 first, then the filing surface aligning with the number 2 on the handle 42, then the filing surface aligning with the number 3 on the handle 42 and finally the filing surface aligning with the number 4 on the handle 42. It is of course possible to deviate from the suggested order of use of the filing surfaces, if the manicurist deems it worthwhile.

As the filing surfaces on the sides 48 of the cover 44 are used to file, brush, sand and/or polish nails, the filing surfaces will wear out. To this end, covers 44 are designed to be replaceable and multiple covers 44 can be sold in a kit with a single handle 42.

Handle 42 and cover 44 can have any of a variety of different forms and cross-sections, not limited to the substantially square cross-section as shown. For example, although a four-sided handle 42 and cover 44 are shown, each can be provided with only three sides, i.e., a triangular cross-section. In this case, only three filing surfaces can be provided. Also, although the handle 42 and cover 44 are shown with flat sides, the sides can be curved.

Figure 5:
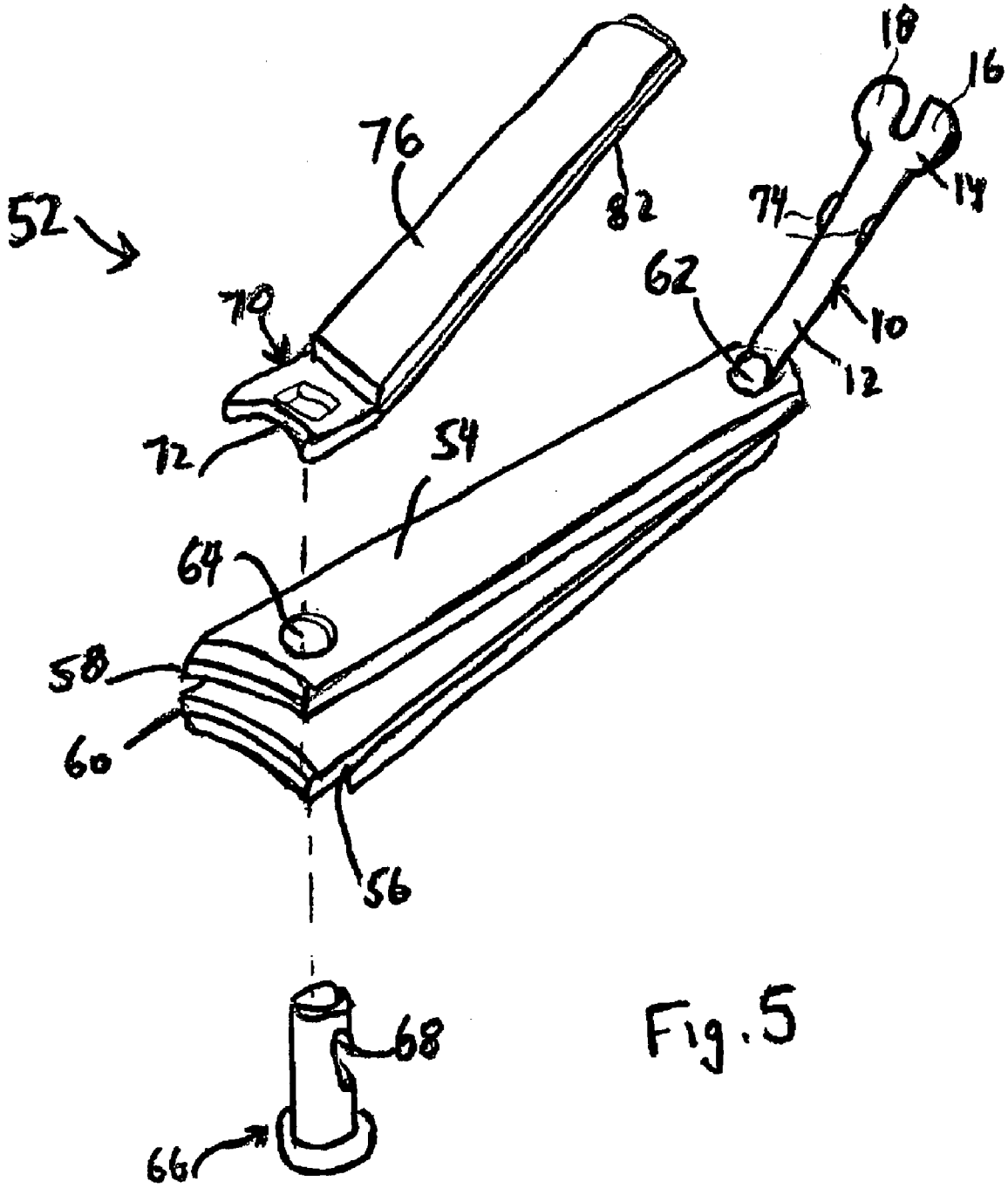
FIG. 5 is an exploded perspective view of another embodiment of a manicure instrument including a manicure implement in accordance with the invention.
Figure 6:
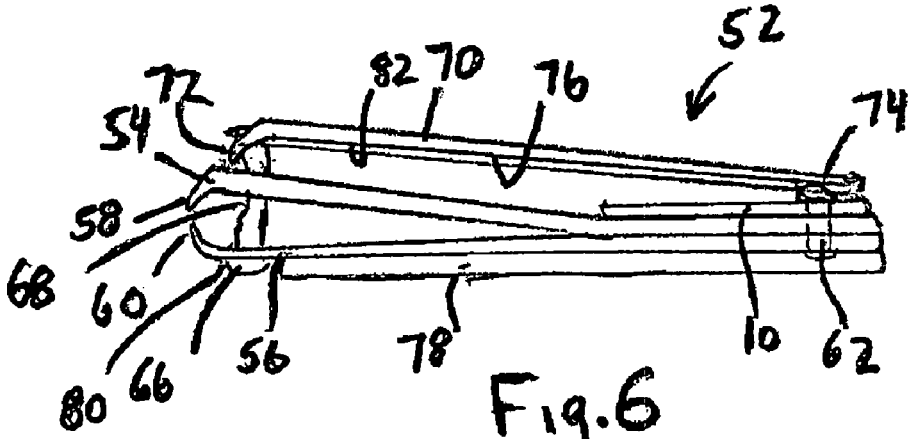
FIG. 6 is a side view of the manicure instrument shown in FIG. 5.

FIGS. 5 and 6 show another manicure instrument including the manicure implement 10 in accordance with the invention. Manicure instrument 52 includes upper and lower plates 54, 56 joined together at their rear ends through a riveting process or a welding process into an elastic single body, with a sharpened jaw 58, 60 formed at a front edge of the respective plate 54 or 56. Manicure implement 10 in accordance with the invention is rotatably mounted to a rear joint 62 of the upper and lower plates 54, 56 (a rivet or pivot pin) such that the manicure implement 10 is rotatable between a folded, storage position alongside the upper plate 54 and an exposed, operational position extending outward from the upper and lower plates 54, 56. A shaft hole 64 is formed at each of the front parts of the upper and lower plates 54, 56, while a shaft 66 having a base upwardly penetrates the shaft holes 64 of the upper and lower plates 54, 56 such that the base of the shaft 66 is stopped on the lower surface of the lower plate 56. The shaft 66 has a hook 68 on its sidewall.

A lever 70, having a hinge rib 72 at its front end, is movably caught by the hook 68 of the shaft 66 at the hinge rib 72. The lever 70 is normally biased upward by the elastic upper plate 54, and so it is possible to maintain the movable engagement of the hinge rib 72 of the lever 70 with the hook 68 of the shaft 64 without allowing an undesired removal of the lever 70 from engagement with the hook 68.

Lever 70 has a first operational position shown in FIG. 5 in which it can be pressed downward toward the upper plate 54 to cause movement of the jaws 58, 60 together and a second, storage position shown in FIG. 6 in which it lies against the manicuring implement 10 and aligns with the upper and lower plates 54, 56. To maintain the lever 70 in the storage position, the manicure implement 10 is provided with upraised projections 74 extending from its edges.

Manicure instrument 52 is capable of trimming nails by placing each nail between the jaws 58, 60 and pressing the upper and lower plates 54, 56 together using lever 70 (i.e., by pressing lever 70 downward toward the upper plate 54), as well as cleaning underneath the nails. Nail cleaning is achieved by placing each nail into the indentation 20 in manicuring implement 10 when manicuring implement 10 is rotated outward away from the upper plate 54, with either the straight jaw 16 or the curved jaw 18 being positioned below the nail. With either jaw 16 or 18 in position below the nail, the upper and lower plates 54, 56 are then twisted to cause the jaw 16 or 18 to scrape along the underside of the nail between the nail and the underlying skin and eject accumulated particulate matter therefrom.

When trimming nails, the manicure implement 10 can be rotated into its folded, storage position along the upper plate 54. In this position, the manicure implement 10 will not interfere with the nail trimming procedure. When cleaning underneath nails using manicure implement 10, the lever 70 can be rotated into its storage position. In this position, the lever 70 will not interfere with the nail cleaning procedure.

To ease use of the manicure instrument 52 when trimming nails, to reduce potentially abrasive contact between the manicurist's fingers and the manicure instrument 52, and to provide a more secure grip of the manicure instrument 52 during use, cushioning pads 76, 78 are arranged on the lever 70 and the lower surface 80 of the lower plate 56. Pad 76 is arranged on the force-application surface 82 of the lever 70 which faces upward when the lever 70 is in its use position as shown in FIG. 5. However, since surface 82 faces the upper plate 54 when the lever 70 is in its storage position, surface 82 is the underside of the lever 70.

Pads 76, 78 may be made of rubber or another suitable material to provide cushioning and/or a more secure grip.

It is possible to modify manicure instrument 10 to include additional manicure implements, such as nail files, by rotatably mounting an end of each implement to the rear joint 62. Each additional implement would be rotated out of the gap between the upper and lower plates 54, 56 for use and retained inside the gap when not in use.

Figure 7:
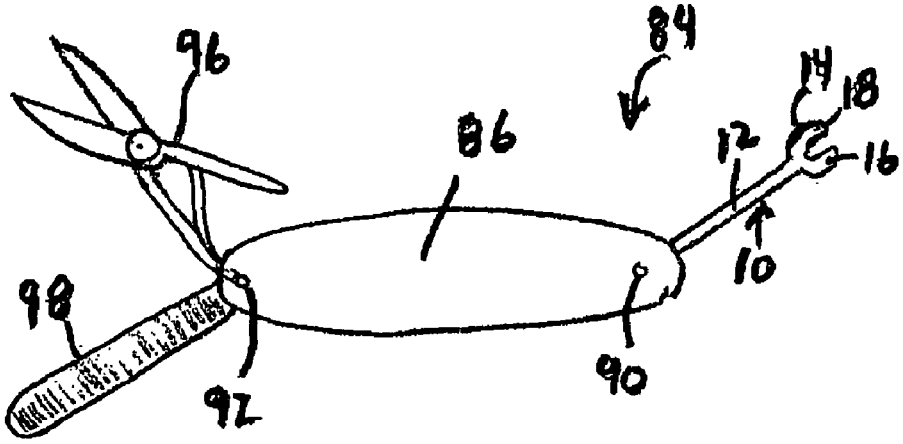
FIG. 7 is a top view of another embodiment of a manicure instrument including a manicure implement in accordance with the invention.
Figure 8:
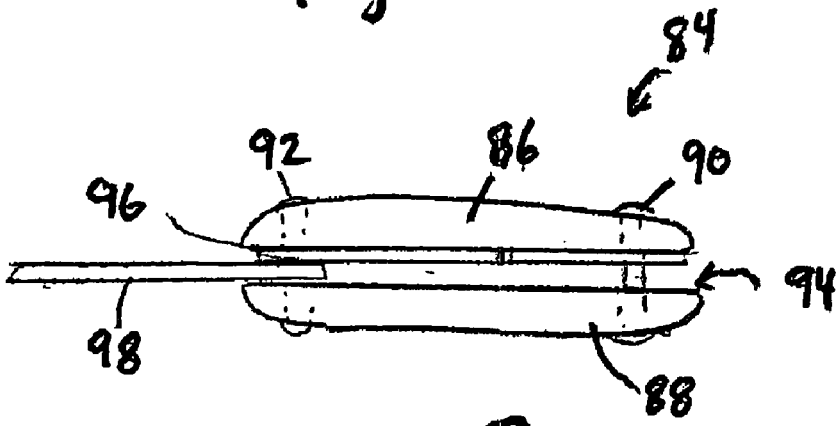
FIG. 8 is a side view of the manicure instrument shown in FIG. 7 with some implements in their storage position.

FIGS. 7 and 8 show another manicure instrument including the manicure implement 10 in accordance with the invention. Manicure instrument 84 includes upper and lower cheeks 86, 88 joined together at opposed ends by rivets or pivot pins 90, 92. Manicure implement 10 in accordance with the invention is rotatably mounted to the pivot pin 90 such that it is rotatable between a folded, storage position inside a gap 94 between the upper and lower cheeks 86, 88 and an exposed, operational position extending outward from the upper and lower cheeks 86, 88.

Nail scissors 96 and a nail file 98 are rotatably mounted to the pivot pin 92 and can be rotated out of the gap 94 between the upper and lower cheeks 86, 88 for use and retained inside the gap 94 when not in use (FIG. 8 shows the nail scissors 96 in the gap 94 and the nail file 98 out of the gap 94). Instead of nail scissors 96 and a nail file 98, other manicure implements and different combinations of manicure implements can be rotatably mounted on the pivot pins 90, 92.

To use each manicure implement 10, 96, 98, it is pivoted outward from the gap 94 between the upper and lower cheeks 86, 88, used and then pivoted back to its storage position in the gap 94. Use of manicure implement 10 is as described above.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A manicuring implement for cleaning underneath nails, comprising:

a shaft; and an operative head arranged on said shaft, said head including first and second fixed jaws defining an indentation therebetween, said first jaw having a straight inner surface forming one side of said indentation and an outer surface having a straight portion on an opposite side of said first jaw from said inner surface, said second jaw having an inwardly curved concave inner surface forming the other side of said indentation and an outer surface having a curved portion on an opposite side of said second jaw from said inner surface, said inwardly curved concave inner surface facing said straight inner surface of said first jaw and curving inward from a point at a forward edge of said inner surface toward a rear portion of said straight inner surface of said first jaw, whereby said first and second jaws are independently insertable below nails to remove accumulated matter from below the nails.

2. The manicuring implement of claim 1, wherein said shaft is thicker than said head and tapers toward said head.

3. A manicuring instrument, comprising: the manicuring implement of claim 1; and a handle, said shaft of said implement being fixed to said handle in a position in which said head is exposed.

4. The manicuring instrument of claim 3, further comprising a cover including a slot arranged to receive an exposed portion of said shaft and said head when said cover is arranged in connection with said handle.

5. The manicuring instrument of claim 4, wherein said handle and said cover have substantially the same cross-sectional shape.

6. The manicuring instrument of claim 4, wherein said cover and said handle each have a plurality of sides, said sides of said cover each including a different coarseness filing surface.

7. The manicuring instrument of claim 6, wherein each different coarseness filing surface includes a unique color, said sides of said handle being colored the same colors as said filing surfaces on said cover.

8. The manicuring instrument of claim 6, wherein each different coarseness filing surface is numbered in a pattern to provide for a desired sequence of use of said filing surfaces on said cover.

9. A manicuring instrument, comprising:

the implement of claim 1;

upper and lower plates joined together at rear ends and defining opposing sharpened jaws at front ends, said implement being movably connected to said upper plate; and a lever arranged to urge said jaw of said upper plate against said jaw of said lower plate to enable nail and cuticle trimming.

10. The manicuring instrument of claim 9, further comprising a rivet or pivot pin for joining said upper and lower plates together at a pivot point, said implement being connected to said rivet or pivot pin to rotate about said pivot point.

11. The manicuring instrument of claim 9, wherein said implement includes upraised projections extending from edges, said lever being retainable in a storage position between said projections.

12. The manicuring instrument of claim 9, further comprising a cushioning pad arranged on at least one of a force-application surface of said lever and a lower surface of said lower plate.

13. A manicuring instrument, comprising:

the manicuring implement of claim 1;

upper and lower cheeks, and rivets or pivot pins for joining said upper and lower cheeks together at opposed ends and to define a gap therebetween, said implement being rotatably mounted to one of said rivets or pivot pins such that it is rotatable between a folded, storage position inside said gap and an exposed, operational position extending outward from said upper and lower cheeks.

14. The manicuring instrument of claim 13, further comprising at least one other manicuring implement rotatably mounted to one of said rivets or pivot pins.

15. A method for manicuring nails, comprising:

providing a handle having at least three lateral sides;

attaching a shaft of a manicuring implement for cleaning underneath nails to the handle, the manicuring implement having an operative nail-cleaning head arranged on the shaft;

providing a cover including a slot arranged to receive an exposed portion of the shaft and the head when the cover is arranged in connection with the handle, the cover having the same number of lateral sides as the handle;

arranging different grade filing surfaces on the lateral sides of the cover, each filing surface having a unique color;

coloring the lateral sides of the handle the same colors as the colors of the filing surfaces on the cover;

sequentially numbering the lateral sides of the handle to correspond to a desired sequence of use of the filing surfaces on the lateral sides of the cover when the colored lateral sides of the handle are aligned with the colored filing surfaces on the lateral sides of the cover;

placing the cover into connection with the handle in preparation for filing the nails; and filing the nails using the filing surfaces on the lateral sides of the cover in accordance with the numeric sequence on the lateral sides of the handle when the cover is arranged in connection with the handle.

16. The method of claim 15, further comprising cleaning the nails using the operative head of the manicuring implement.

17. The method of claim 15, wherein the head includes first and second fixed jaws defining an indentation therebetween, the first jaw having a straight inner surface forming one side of the indentation and an outer surface having a straight portion on an opposite side of the first jaw from the inner surface, the second jaw having a curved inner surface forming the other side of the indentation and an outer surface having a curved portion on an opposite side of the second jaw from the inner surface.

18. The method of claim 17, further comprising cleaning each of the nails by inserting one of the first and second jaws underneath the nail and moving that jaw along the underside of the nail.

19. A manicuring instrument, comprising:

a manicuring implement for cleaning underneath nails comprising:

a shaft; and an operative head arranged at an end of said shaft, said head including first and second fixed jaws defining an indentation therebetween;

said first jaw having a straight inner surface forming one side of said indentation and an outer surface having a straight portion on an opposite side of said first jaw from said inner surface;

said second jaw having an inwardly curved inner surface forming the other side of said indentation and an outer surface having a curved portion on an opposite side of said second jaw from said inner surface;

whereby said first and second jaws are independently insertable below nails to remove accumulated matter from below the nails;

a handle, said shaft of said implement being fixed to said handle in a position in which said head is exposed; and a cover including a slot arranged to receive an exposed portion of said shaft and said head when said cover is arranged in connection with said handle, said cover having a plurality of lateral sides, all of said lateral sides of said cover including a different coarseness filing surface.

20. The manicuring instrument of claim 19, wherein said cover and said handle have the same cross-sectional shape such that said handle has a plurality of lateral sides equal in number to the number of lateral sides of said cover, each different coarseness filing surface having a unique color, said lateral sides of said handle being colored the same colors as said filing surfaces on said cover.

* * * * *